US009341992B2

(12) United States Patent
Takahashi et al.

(10) Patent No.: US 9,341,992 B2
(45) Date of Patent: May 17, 2016

(54) IMAGE FORMING APPARATUS AND IMAGE FORMING METHOD

(71) Applicant: FUJI XEROX CO., LTD., Tokyo (JP)

(72) Inventors: Masaaki Takahashi, Kanagawa (JP); Yoshiki Shimodaira, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/686,025

(22) Filed: Apr. 14, 2015

(65) Prior Publication Data

US 2016/0077467 A1 Mar. 17, 2016

(30) Foreign Application Priority Data

Sep. 17, 2014 (JP) ..... 2014-189432

(51) Int. Cl.

*G03G 15/16* (2006.01)
*G03G 21/00* (2006.01)
*G03G 15/00* (2006.01)

(52) U.S. Cl.

CPC ..... *G03G 15/163* (2013.01); *G03G 15/168* (2013.01); *G03G 15/5058* (2013.01); *G03G 2215/1647* (2013.01)

(58) Field of Classification Search

CPC . G03G 15/163; G03G 15/161; G03G 15/168; G03G 15/5058; G03G 15/5062; G03G 2215/1647; G03G 2215/1661

USPC ..... 399/101, 66, 71, 72, 301

See application file for complete search history.

(56) References Cited

U.S. PATENT DOCUMENTS 4,684,243 A * 8/1987 Minor ..... G03G 15/5062 399/72 X
7,359,652 B2 * 4/2008 Kodama ..... G03G 15/5062 399/72 X
7,616,909 B2 * 11/2009 Kato ..... G03G 15/161 399/301 X
2013/0022372 A1 * 1/2013 Bucks ..... G03G 15/0893 399/254
2013/0243473 A1 * 9/2013 Noguchi ..... G03G 15/0131 399/101

FOREIGN PATENT DOCUMENTS

JP H11-119478 A 4/1999
JP 2002-072588 A 3/2002

* cited by examiner

*Primary Examiner* — Sophia S Chen
(74) *Attorney, Agent, or Firm* — Oliff PLC

(57) ABSTRACT

An image forming apparatus includes first and second forming units that form first and second to-be-transferred images and first and second not-to-be-transferred images with first and second toners, respectively, the first toner containing a metal pigment; a transfer body to which the first and second to-be-transferred and not-to-be-transferred images are to be transferred; a transfer member that transfers the first and second to-be-transferred images to a recording medium at a transfer nip between the transfer member and the transfer body; and a removing member that removes, with an electrostatic force, the first and second toners forming the first and second not-to-be-transferred images from the transfer member. In a transfer mode, the first not-to-be-transferred image is transferred to a position that do not overlap the recording medium to be introduced into the transfer nip after the first not-to-be-transferred image when seen in a direction of introduction of the recording medium.

7 Claims, 7 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2014-189432 filed Sep. 17, 2014.

BACKGROUND (i) Technical Field

The present invention relates to an image forming apparatus and an image forming method.

(ii) Related Art

In a related-art technique, a to-be-transferred image formed of a toner containing a metal pigment (hereinafter referred to as metal toner) is transferred to a transfer body such as an intermediate transfer belt, and the to-be-transferred image is then transferred to a recording medium that is introduced into a transfer nip formed between the transfer body and a transfer member such as a second transfer belt. In such a configuration, a not-to-be-transferred image such as a patch image that is not to be transferred to the recording medium is also transferred to the transfer body. The not-to-be-transferred image is then transferred to the transfer member. Subsequently, the metal toner forming the not-to-be-transferred image on the transfer member is removed from the transfer member by utilizing an electrostatic force generated by applying a voltage to a removing member.

SUMMARY

According to an aspect of the invention, there is provided an image forming apparatus including a first forming unit that forms a first to-be-transferred image and a first not-to-be-transferred image with a first toner containing a metal pigment; a second forming unit that forms a second to-be-transferred image and a second not-to-be-transferred image with a second toner that is free of any metal pigment; a transfer body to which the first to-be-transferred image, the first not-to-be-transferred image, the second to-be-transferred image, and the second not-to-be-transferred image are to be transferred; a transfer member that transfers the first to-be-transferred image and the second to-be-transferred image to a recording medium at a transfer nip between the transfer member and the transfer body; and a removing member that removes particles of the first toner forming the first not-to-be-transferred image and particles of the second toner forming the second not-to-be-transferred image that have adhered to the transfer member from the transfer member with an electrostatic force. The image forming apparatus has a transfer mode in which the first not-to-be-transferred image is transferred to a position of the transfer body that is on an outer side of the recording medium to be introduced into the transfer nip after the first not-to-be-transferred image, the position being on the outer side of the recording medium when seen in a direction of introduction of the recording medium into the transfer nip.

BRIEF DESCRIPTION OF THE DRAWINGS

An exemplary embodiment of the present invention will be described in detail based on the following figures, wherein.

DETAILED DESCRIPTION

Figure 1:
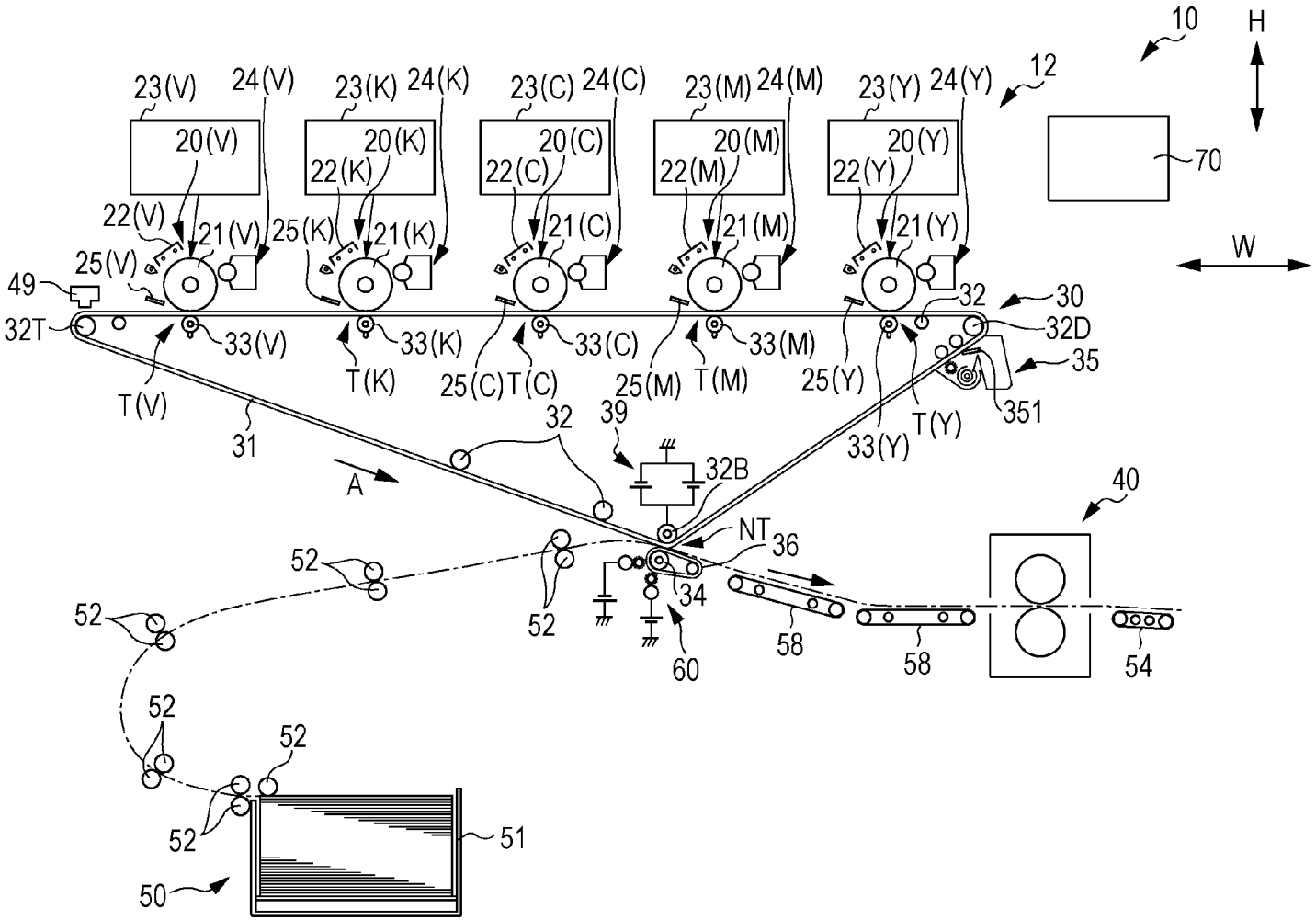
FIG. 1 is a schematic front view of an image forming apparatus according to the embodiment.

An exemplary embodiment of the present invention will now be described with reference to the accompanying drawings. In the drawings, an arrow H represents the vertical direction, and an arrow W represents the horizontal direction corresponding to the width direction of an image forming apparatus.

Configuration of Image Forming Apparatus 10

FIG. 1 is a schematic front view of an image forming apparatus 10 according to the embodiment of the present invention. As illustrated in FIG. 1, the image forming apparatus 10 includes an image forming section 12 that electrophotographically forms an image on a recording medium P such as paper, a transport device 50 that transports the recording medium P, and a controller 70 that controls operations of elements included in the image forming apparatus 10.

Transport Device 50

As illustrated in FIG. 1, the transport device 50 includes a container 51 that contains recording media P, plural transport rollers 52 that transport each of the recording media P from the container 51 to a second-transfer position NT, plural transport belts 58 that transport the recording medium P from the second-transfer position NT to a fixing device 40, and a transport belt 54 that transports the recording medium P from the fixing device 40 toward a discharge portion (not illustrated) to which the recording medium P is discharged.

Image Forming Section 12

The image forming section 12 includes toner-image-forming units 20 that form respective toner images, a transfer device 30 that transfers the toner images formed by the toner-image-forming units 20 to the recording medium P, and the fixing device 40 that applies heat and pressure to the toner images transferred to the recording medium P and thus fixes the toner images to the recording medium P.

In the embodiment, five toner-image-forming units 20 are provided so that toner images of different colors of yellow (Y), magenta (M), cyan (C), black (K), and a first special color (V) are formed, respectively. The toner-image-forming units 20 are arranged in a direction of transport by a transfer belt 31, to be described separately below, from the upstream side toward the downstream side in the order of the unit for yellow (Y), the unit for magenta (M), the unit for cyan (C), the unit for black (K), and the unit for the first special color (V).

In the image forming section 12, the toner-image-forming units 20 for yellow (Y), magenta (M), cyan (C), and black (K) are provided as standard equipment, and the four colors are defined as standard colors. The toner-image-forming unit 20 for the first special color (V) is, for example, an optional unit added to the image forming section 12.

Suffixes (Y), (M), (C), (K), and (V) provided to associated reference numerals in FIG. 1 represent the colors allocated to respective elements. Herein, the suffixes (Y), (M), (C), (K), and (V) may be used without the parentheses. The first special color (V) is, for example, silver or gold. The embodiment concerns a case where the first special color (V) is silver produced by a toner containing a metal pigment. The toner containing the metal pigment may also contain any other pigments in addition to the metal pigment.

Toner-Image-Forming Units 20

Figure 2:
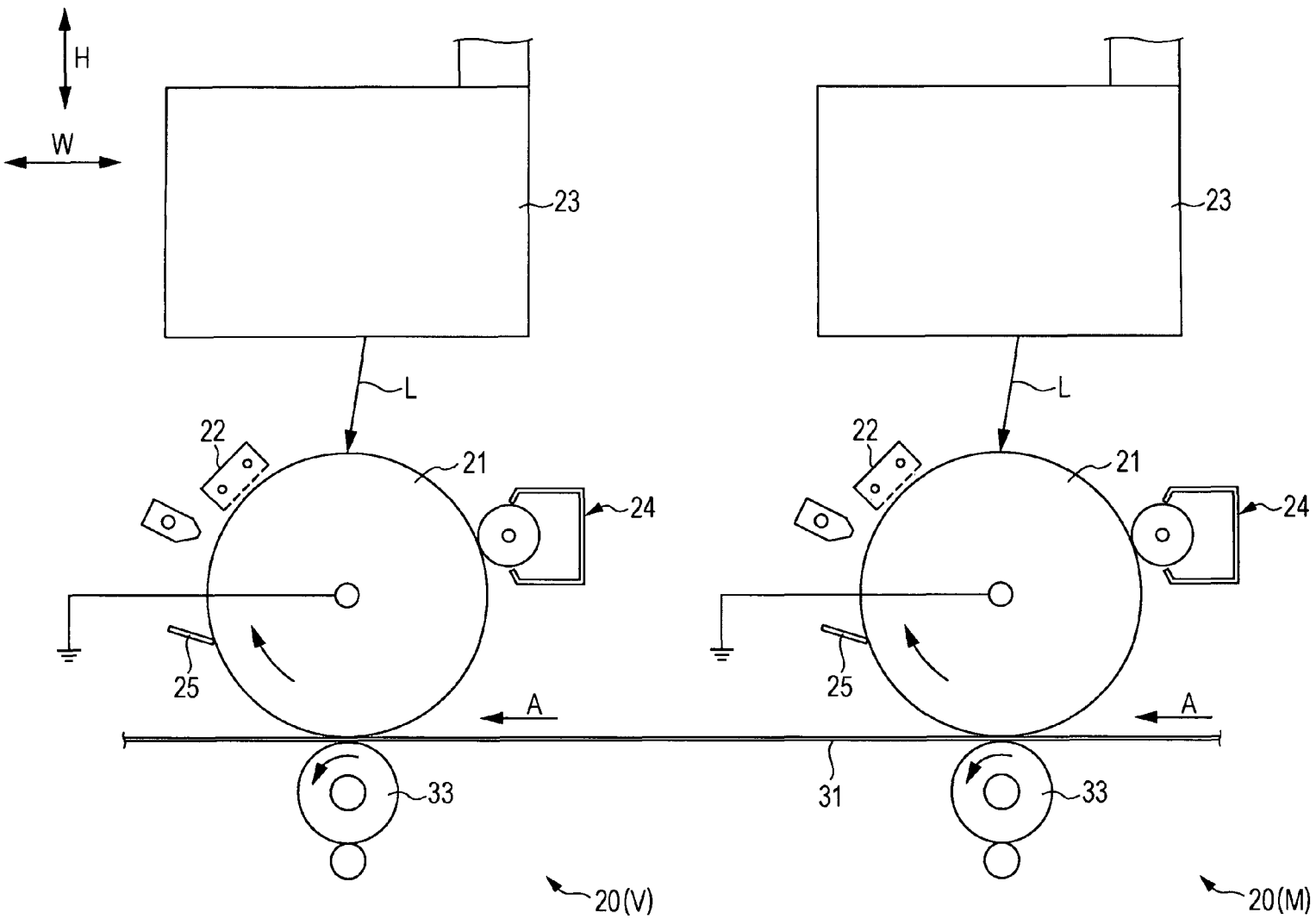
FIG. 2 schematically illustrates toner-image-forming units according to the embodiment.

The toner-image-forming units 20 for the respective colors all have the same configuration, basically, except the toners to be used. Specifically, as illustrated in FIG. 2, the toner-image-forming units 20 for the respective colors each include a photoconductor drum 21 as an exemplary forming body that rotates clockwise in FIG. 2, a charger 22 that charges the photoconductor drum 21, an exposure device 23 that exposes the photoconductor drum 21 charged by the charger 22 to light and thus forms an electrostatic latent image on the photoconductor drum 21, a developing device 24 that develops the electrostatic latent image formed on the photoconductor drum 21 by the exposure device 23 into a toner image, and a blade 25 that removes toner particles remaining on the surface of the photoconductor drum 21 after the toner image is transferred to the transfer device 30.

The charger 22 negatively charges the surface (a photosensitive layer) of the photoconductor drum 21, for example. When exposure light L emitted from the exposure device 23 is applied to a portion of the negatively charged surface of the photoconductor drum 21, that portion comes to have positive polarity, whereby an electrostatic latent image is formed on the surface of the photoconductor drum 21. Then, particles of the toner that have been negatively charged by friction in the developing device 24 are attracted to the positively charged electrostatic latent image, whereby the electrostatic latent image is developed into a toner image on the surface (outer circumferential surface) of the photoconductor drum 21. The blade 25 is in contact with the surface of the photoconductor drum 21 and scrapes toner particles remaining on the surface of the photoconductor drum 21.

Transfer Device 30

The transfer device 30 transfers, for first transfer, the toner images on the respective photoconductor drums 21 to the transfer belt 31 (an intermediate transfer body) such that the toner images are superposed one on top of another. The transfer device 30 then transfers, for second transfer, the superposed toner images to a recording medium P at the second-transfer position NT (an exemplary transfer nip). Specifically, as illustrated in FIG. 1, the transfer device 30 includes the transfer belt 31 as an exemplary transfer body, first-transfer rollers 33 as exemplary transfer units, a second-transfer belt 36 as an exemplary transfer member, a cleaning device 60 as an exemplary removing body that cleans the second-transfer belt 36, and a cleaning device 35 that cleans the transfer belt 31.

Transfer Belt 31

As illustrated in FIG. 1, the transfer belt 31 is endless and is stretched around plural rollers 32, thereby being positioned. In the embodiment, the transfer belt 31 has an inverted obtuse-triangular shape spreading in the width direction of the image forming apparatus 10 in front view. A roller 32D, which is one of the plural rollers 32, illustrated in FIG. 1 functions as a driving roller that receives power from a motor (not illustrated) and thus rotates the transfer belt 31 in a direction of an arrow A. While the transfer belt 31 rotates in the direction of the arrow A, the toner images transferred thereto in the first transfer are transported to the second-transfer position NT.

A roller 32T, which is another one of the plural rollers 32, illustrated in FIG. 1 functions as a tension applying roller that applies tension to the transfer belt 31. A roller 32B, which is yet another one of the plural rollers 32, illustrated in FIG. 1 functions as a counter roller that is provided against a second-transfer roller 34. The counter roller 32B supports a position of the transfer belt 31 that is at the lower obtuse vertex of the inverted obtuse triangle. The upper side of the transfer belt 31 that extends in the width direction of the image forming apparatus 10 as described above is in contact with the photoconductor drums 21 for the respective colors from below.

First-Transfer Rollers 33

The first-transfer rollers 33 transfer the toner images on the respective photoconductor drums 21 to the transfer belt 31. As illustrated in FIG. 1, the first-transfer rollers 33 are provided on the inner side of the transfer belt 31 and across the transfer belt 31 from the respective photoconductor drums 21. A first-transfer voltage having opposite polarity to the toners is applied to each of the first-transfer rollers 33 from a power supply unit (not illustrated). With the application of the first-transfer voltage to the first-transfer rollers 33, the toner images on the respective photoconductor drums 21 are each transferred to the transfer belt 31 at a corresponding one of first-transfer positions T defined between a corresponding one of the photoconductor drums 21 and a corresponding one of the first-transfer rollers 33.

Second-Transfer Belt 36

Figure 3:
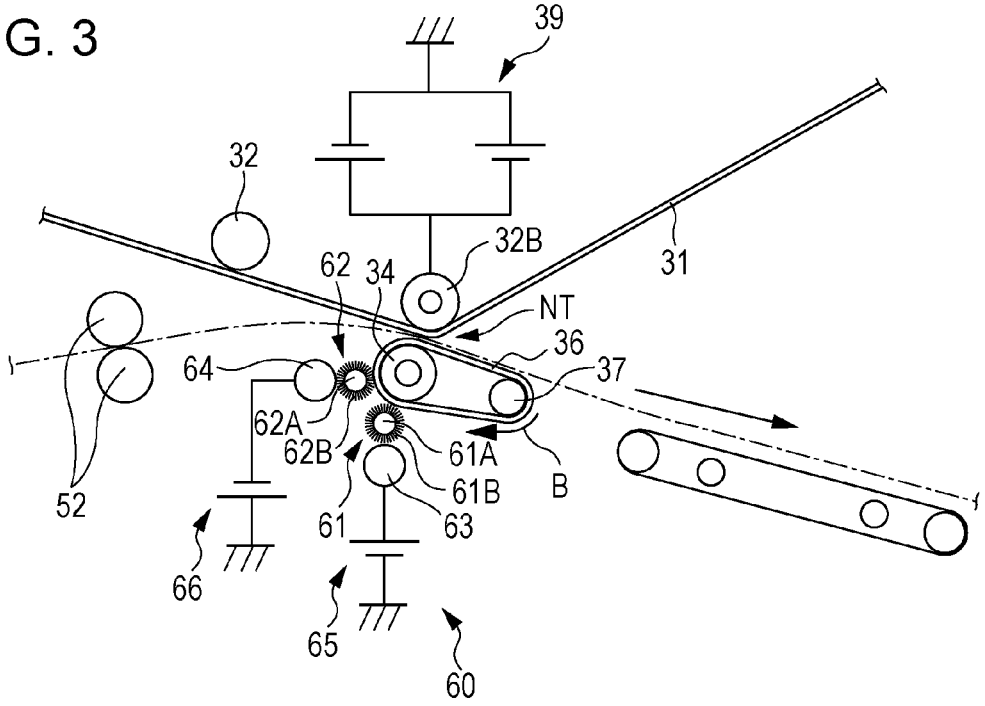
FIG. 3 schematically illustrates a transfer device according to the embodiment.

The second-transfer belt 36 is a belt with which the toner images superposed on the transfer belt 31 are transferred to a recording medium P. As illustrated in FIG. 3, the second-transfer belt 36 is endless and is stretched between the second-transfer roller 34 and a follower roller 37.

The transfer belt 31 and the second-transfer belt 36 are held between the second-transfer roller 34 and the counter roller 32B. The second-transfer belt 36 and the transfer belt 31 are in contact with each other under a predetermined load. The contact point between the second-transfer belt 36 and the transfer belt 31 is defined as the second-transfer position NT. A recording medium P is supplied from the container 51 to the second-transfer position NT at a required timing. When the second-transfer roller 34 is driven and is rotated, the second-transfer belt 36 is rotated in a direction of an arrow B.

In the embodiment, to transfer the toner images on the transfer belt 31 to the recording medium P, a negative voltage is applied to the counter roller 32B by a power supply unit 39 as an exemplary applying unit. Thus, a potential difference is produced between the counter roller 32B and the second-transfer roller 34. That is, since a negative voltage is applied to the counter roller 32B, a second-transfer voltage (a positive voltage) having the opposite polarity to the toners is indirectly applied to the second-transfer roller 34, which functions as a counter electrode for the counter roller 32B. Thus, the toner images on the transfer belt 31 are transferred to the recording medium P passing through the second-transfer position NT.

In contrast, to keep the toners on the transfer belt 31 retained on the transfer belt 31 while passing through the second-transfer position NT, a positive voltage is applied to the counter roller 32B from the power supply unit 39 as an applying unit. Thus, a potential difference is produced between the counter roller 32B and the second-transfer roller 34. That is, since a positive voltage is applied to the counter roller 32B, a non-transfer voltage (a negative voltage) having the same polarity as the toners is indirectly applied to the second-transfer roller 34 as the counter electrode for the counter roller 32B. Thus, the toners passing through the second-transfer position NT receive a repulsive force from the second-transfer roller 34 and are kept retained on the transfer belt 31.

Cleaning Device 60 for Second-Transfer Belt 36

As illustrated in FIG. 3, the cleaning device 60 includes a first cleaning brush 61 and a second cleaning brush 62 as exemplary removing members that remove toner particles (particles of the toners having the silver color and the other colors to be described separately below) from the second-transfer belt 36 by attracting the toner particles with electrostatic forces generated in accordance with cleaning voltages applied thereto. The first cleaning brush 61 and the second cleaning brush 62 include respective shaft portions 61A and 62A, and respective brush portions 61B and 62B provided around and over the entirety of the respective shaft portions 61A and 62A. The shaft portions 61A and 62A are driven and are rotated, whereby the first cleaning brush 61 and the second cleaning brush 62 are rotated. The first cleaning brush 61 and the second cleaning brush 62 are rotated in, for example, a direction (clockwise in FIG. 3) the same as the direction of rotation of the second-transfer belt 36. Alternatively, the first cleaning brush 61 and the second cleaning brush 62 may be rotated in a direction (counterclockwise in FIG. 3) opposite to the direction of rotation of the second-transfer belt 36. If the first cleaning brush 61 and the second cleaning brush 62 are rotated in the direction opposite to the direction of rotation of the second-transfer belt 36, the first cleaning brush 61 and the second cleaning brush 62 are each configured to rotate at, for example, a peripheral velocity different from the peripheral velocity of the second-transfer belt 36.

The cleaning device 60 further includes a first metal roller 63 that is in contact with the brush portion 61B of the first cleaning brush 61, and a second metal roller 64 that is in contact with the brush portion 62B of the second cleaning brush 62.

The cleaning device 60 further includes a first power-feeding unit 65 that applies a positive cleaning voltage to the first metal roller 63, and a second power-feeding unit 66 that applies a negative cleaning voltage to the second metal roller 64.

When the first power-feeding unit 65 applies the positive cleaning voltage to the first metal roller 63, a direct cleaning current flows through the second-transfer roller 34, the first cleaning brush 61, and the first metal roller 63. Accordingly, the first cleaning brush 61 comes to have positive polarity with respect to the second-transfer roller 34, and the first metal roller 63 comes to have positive polarity with respect to the first cleaning brush 61.

Hence, negatively charged particles of the toners on the second-transfer belt 36 are electrostatically attracted to the first cleaning brush 61 and are moved to the first metal roller 63, thereby being removed from the second-transfer belt 36.

When the second power-feeding unit 66 applies the negative cleaning voltage to the second metal roller 64, a direct cleaning current flows through the second-transfer roller 34, the second cleaning brush 62, and the second metal roller 64. Accordingly, the second cleaning brush 62 comes to have negative polarity with respect to the second-transfer roller 34, and the second metal roller 64 comes to have negative polarity with respect to the second cleaning brush 62.

Hence, positively charged particles of the toners on the second-transfer belt 36 are electrostatically attracted to the second cleaning brush 62 and are moved to the second metal roller 64, thereby being removed from the second-transfer belt 36.

The toner particles thus moved to the first metal roller 63 and to the second metal roller 64 are removed from the first metal roller 63 and the second metal roller 64 by respective removing members (not illustrated) such as blades. The toner particles thus removed from the first metal roller 63 and the second metal roller 64 are collected into respective containers (not illustrated).

Cleaning Device 35 for Transfer Belt 31

As illustrated in FIG. 1, the cleaning device 35 is provided on the downstream side with respect to the second-transfer position NT and on the upstream side with respect to the first-transfer position T(Y) in the direction of rotation of the transfer belt 31. The cleaning device 35 includes a blade 351 that scrapes toner particles remaining on the surface of the transfer belt 31 from the surface of the transfer belt 31.

Featured Configuration

In the embodiment, the toner-image-forming unit 20V as an exemplary first forming unit forms a toner image with the toner having the silver color as the first special color (V) (see FIG. 1). The silver toner (an exemplary first toner) used in the toner-image-forming unit 20V contains a metal pigment and a binder resin. The metal pigment is a metal such as aluminum. The toner-image-forming unit 20V forms a to-be-transferred image that is to be transferred to the recording medium P, and a not-to-be-transferred image that is not to be transferred to the recording medium P.

Examples of the not-to-be-transferred image include a density-detection image (a patch) intended for the detection of the toner density of the toner images on the transfer belt 31, a color-misregistration-detection image (a patch) intended for the detection of misregistration among the toner images in the respective colors on the transfer belt 31, an image (a band) for consuming deteriorated developer (toner), an image (a band) for supplying toner to the contact point between each of the photoconductor drums 21 and a corresponding one of the blades 25, and so forth. A detecting unit (sensor) 49 that detects the density-detection image (a patch) or the color-misregistration-detection image (a patch) is provided on the downstream side (on the left side in FIG. 1) with respect to the toner-image-forming unit 20V.

Hereinafter, as a matter of convenience of description, the to-be-transferred image is referred to as "silver image," and the not-to-be-transferred image is referred to as "silver patch."

The toners (exemplary second toners) having the colors of yellow (Y), magenta (M), cyan (C) and black (K) used in the toner-image-forming units 20Y, 20M, 20C, and 20K as exemplary second forming units each do not contain the metal pigment but contain a pigment other than the metal pigment and a binder resin.

Herein, as a matter of convenience of description, the colors of yellow (Y), magenta (M), cyan (C) and black (K) are referred to as "other colors," and the toners having the other colors are referred to as "other-color toners." In each of the drawings, elements provided for the colors of yellow (Y), magenta (M), cyan (C) and black (K) are distinguished from one another by suffixes (Y), (M), (C) and (K).

As described above, the other-color toners do not each contain the metal pigment, whereas the silver toner contains the metal pigment. Therefore, the silver toner has higher conductivity than the other-color toners. Accordingly, electrical charge is injected more easily into the silver toner than into the other-color toners. Furthermore, the silver toner has a larger particle size than the other-color toners.

As with the toner-image-forming unit 20V, the toner-image-forming units 20Y, 20M, 20C, and 20K each form a to-be-transferred image that is to be transferred to the recording medium P, and a not-to-be-transferred image that is not to be transferred to the recording medium P. As with the examples of the silver patch, examples of the not-to-be-transferred image include a density-detection image (a patch), a color-misregistration-detection image (a patch), an image (a band) for consuming deteriorated developer (toner), an image (a band) for supplying toner to the contact point between the photoconductor drum 21 and the blade 25, and so forth. Hereinafter, as a matter of convenience of description, the not-to-be-transferred images formed by the toner-image-forming units 20Y, 20M, 20C, and 20K are each referred to as "other-color patch," and the to-be-transferred images formed by the toner-image-forming units 20Y, 20M, 20C, and 20K are each referred to as "other-color image."

Figure 4:
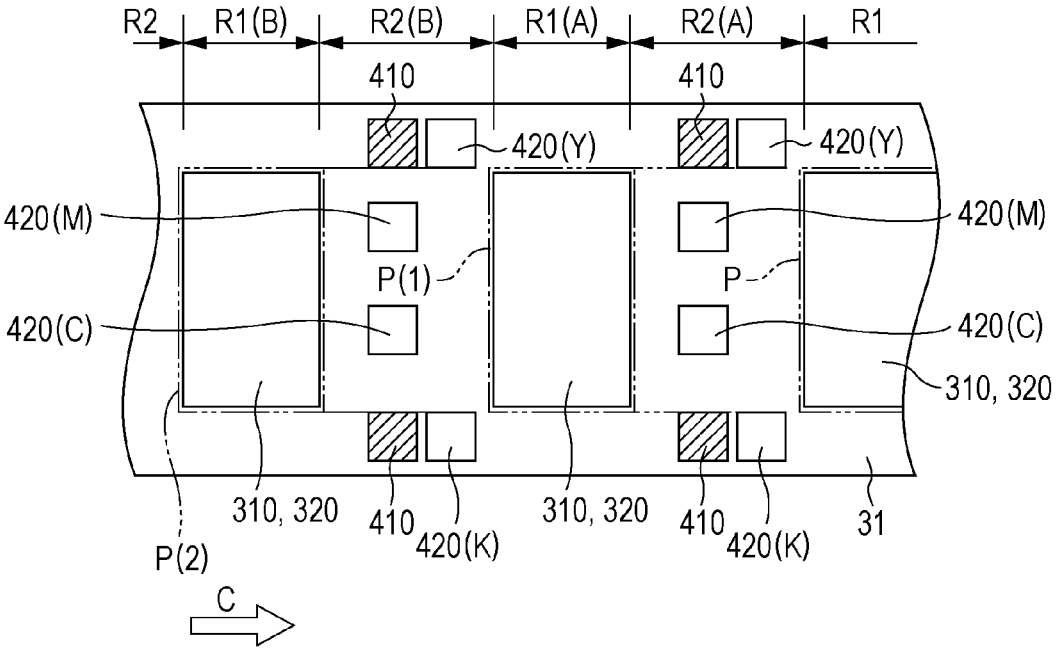
FIG. 4 illustrates not-to-be-transferred images and to-be-transferred images on a transfer belt.

As illustrated in FIG. 4, a silver image 310 and other-color images 320 formed by the respective toner-image-forming units 20 are transferred to each of transfer areas R1 of the transfer belt 31 by the respective first-transfer rollers 33 (exemplary transfer units). The silver image 310 and the other-color images 320 transferred to the transfer belt 31 pass through the second-transfer position NT together with a recording medium P, thereby being transferred to the recording medium P.

Meanwhile, silver patches 410 and other-color patches 420 formed by the toner-image-forming units 20 are transferred by the first-transfer rollers 33 to each of non-transfer areas R2 that is provided between adjacent ones of the transfer areas R1. The silver patches 410 and the other-color patches 420 thus transferred to the transfer belt 31 alone pass through the second-transfer position NT, not together with the recording medium P.

In the embodiment, to transfer the silver image 310 and the other-color images 320 from the transfer belt 31 to a recording medium P, the positive second-transfer voltage (a voltage having the opposite polarity to the toners) is applied to the second-transfer roller 34 via the counter roller 32B as described above. Hence, the silver image 310 and the other-color images 320 passing through the second-transfer position NT together with the recording medium P are transferred from the transfer belt 31 to the recording medium P.

On the other hand, when the silver patches 410 and the other-color patches 420 pass through the second-transfer position NT, a negative non-transfer voltage (a voltage having the same polarity as the toner) is applied to the second-transfer roller 34 via the counter roller 32B so that the silver patches 410 and the other-color patches 420 on the transfer belt 31 are kept retained on the transfer belt 31.

Hence, the toners forming the silver patches 410 and the other-color patches 420 on the transfer belt 31 receive a repulsive force from the second-transfer belt 36 (the second-transfer roller 34) and are retained on the transfer belt 31. The toners forming the silver patches 410 and the other-color patches 420 retained on the transfer belt 31 are then transported to the cleaning device 35 and are removed from the transfer belt 31 by the cleaning device 35.

The second-transfer belt 36 and the transfer belt 31 are in contact with each other under a predetermined load. Therefore, when the silver patches 410 and the other-color patches 420 are formed on the surface of the transfer belt 31, some particles of the toners are transferred to the second-transfer belt 36 even if they are subjected to the electrostatic repulsive force. Moreover, if any particles of the toners forming the silver patches 410 and the other-color patches 420 receive positive charge and are thus positively charged, such particles of the toners are subjected to an electrostatic attracting force and are transferred to the second-transfer belt 36 when passing through the second-transfer position NT.

The injection of positive charge into toner particles is caused by, for example, the discharge occurring in the transfer of the toner images from the photoconductor drums 21 to the transfer belt 31. As described above, electrical charge is injected more easily into the silver toner than into the other-color toners. Therefore, the silver toner is more likely to be transferred to the second-transfer belt 36.

If any particles of the silver toner forming the silver patches 410 and any particles of the other-color toners forming the other-color patches 420 are transferred to the second-transfer belt 36, the particles of the silver toner and the particles of the other-color toners adhere to the second-transfer belt 36 (an exemplary transfer member). When the second-transfer belt 36 rotates, the particles of the silver toner and the particles of the other-color toners are transported to the first cleaning brush 61 and the second cleaning brush 62 and are removed from the second-transfer belt 36 by the first cleaning brush 61 (an exemplary removing member) and the second cleaning brush 62 (another exemplary removing member). Specifically, as described above, since the positive cleaning voltage is applied to the first cleaning brush 61 from the first power-feeding unit 65 (an exemplary applying unit), negatively charged particles of the toners on the second-transfer belt 36 are electrostatically attracted to the first cleaning brush 61 and are thus removed from the second-transfer belt 36. Furthermore, since the negative cleaning voltage is applied to the second cleaning brush 62 from the second power-feeding unit 66 (another exemplary applying unit), positively charged particles of the toners on the second-transfer belt 36 are electrostatically attracted to the second cleaning brush 62 and are thus removed from the second-transfer belt 36.

Figure 5:
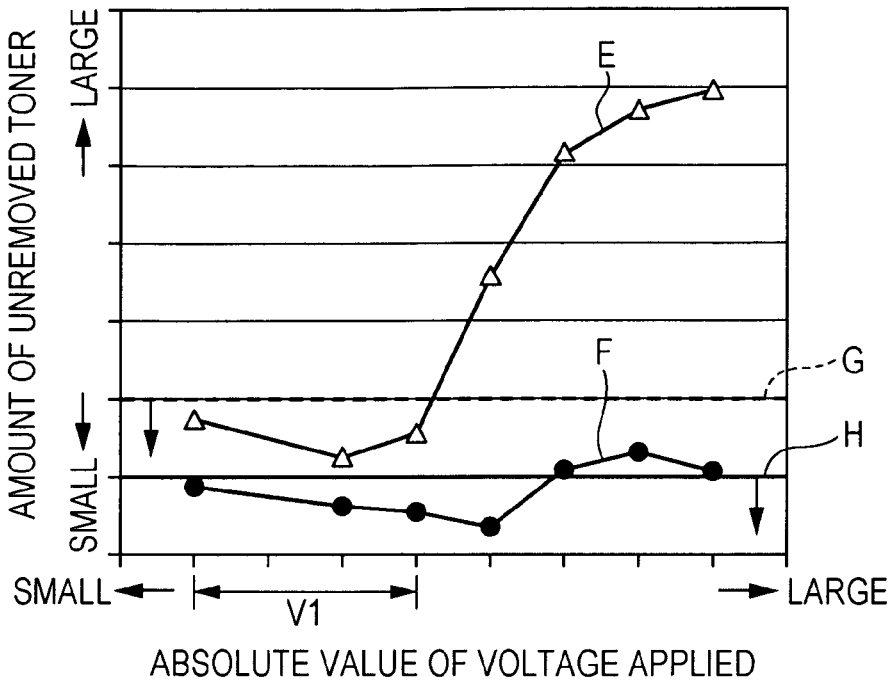
FIG. 5 is a graph illustrating the relationship between the absolute value of a voltage applied to a first cleaning brush and a second cleaning brush and the amount of unremoved toner particles remaining on a second-transfer belt at the beginning of use of the first cleaning brush and the second cleaning brush.
Figure 6:
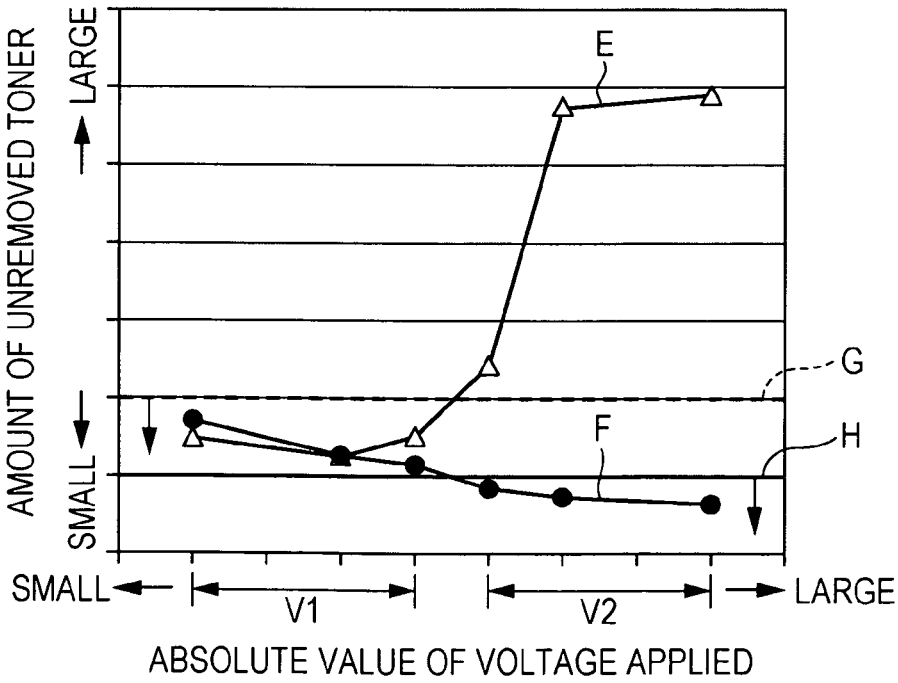
FIG. 6 is a graph illustrating the relationship between the absolute value of a voltage applied to a first cleaning brush and a second cleaning brush and the amount of unremoved toner particles remaining on a second-transfer belt at a point of time after a long use of the first cleaning brush and the second cleaning brush.

FIGS. 5 and 6 are graphs illustrating the relationship between the absolute value of the voltage applied to the first cleaning brush 61 and the second cleaning brush 62 and the amount of unremoved toner particles remaining on the second-transfer belt 36. The graph in FIG. 5 illustrates the relationship at the beginning of use of the first cleaning brush 61 and the second cleaning brush 62. The graph in FIG. 6 illustrates the relationship at a point of time after a long use of the first cleaning brush 61 and the second cleaning brush 62 (for example, after the number of recording media P to which toner images have been transferred has reached a predetermined value or greater).

In each of the graphs in FIGS. 5 and 6, a curve E represents the amount of unremoved particles of the silver toner, a curve F represents the amount of unremoved particles of the other-color toners, a line G represents the allowable amount of unremoved particles of the silver toner, and a bold line H represents the allowable amount of unremoved particles of the other-color toners.

As graphed in FIG. 5, at the beginning of use of the first cleaning brush 61 and the second cleaning brush 62, if, for example, the absolute value of the voltage is within a range V1, the amount of unremoved particles of the silver toner and the amount of unremoved particles of the other-color toners fall within the respective allowable ranges.

However, after a long use of the first cleaning brush 61 and the second cleaning brush 62, the first cleaning brush 61 and the second cleaning brush 62 (or the second-transfer roller 34) deteriorate and have increased electrical resistances. Therefore, unless the absolute value of the voltage is increased, the amount of unremoved particles of the other-color toners does not fall within the allowable range. As graphed in FIG. 6, when the absolute value of the voltage is within a range V2, the amount of unremoved particles of the other-color toners falls within the allowable range. In contrast, the amount of unremoved particles of the silver toner falls within the allowable range when the absolute value of the voltage is within the range V1. That is, when the absolute value of the voltage is high (within the range V2 in FIG. 6, for example), the amount of unremoved particles of the silver toner is large. To summarize, after a long use of the first cleaning brush 61 and the second cleaning brush 62, the voltage suitable for the removal of the silver toner and the voltage suitable for the removal of the other-color toners are different from each other.

Figure 7:
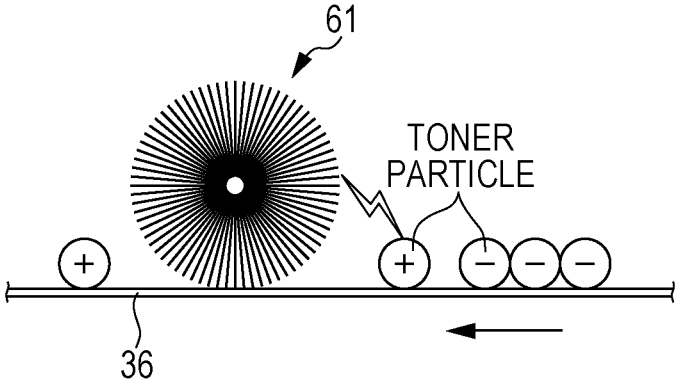
FIG. 7 illustrates how electrical charge generated by the cleaning brush is injected into toner particles.

The reason why the amount of unremoved particles of the silver toner is large when the absolute value of the voltage is high (within the range V2 in FIG. 6, for example) is assumed as follows. For example, as illustrated in FIG. 7, electrical discharge occurs between the first cleaning brush 61 and the second-transfer belt 36 at a position on the upstream side with respect to the point of contact between the first cleaning brush 61 and the second-transfer belt 36. With the electrical discharge, positive charge is injected into some toner particles, and such toner particles are positively charged. The positively charged toner particles receive an electrostatic repulsive force from the first cleaning brush 61. Therefore, the toner particles remain on the second-transfer belt 36 without being attracted to the first cleaning brush 61.

The same applies to the second cleaning brush 62. Electrical discharge occurs between the second cleaning brush 62 and the second-transfer belt 36 at a position on the upstream side with respect to the point of contact between the second cleaning brush 62 and the second-transfer belt 36. With the electrical discharge, negative charge is injected into some toner particles, and such toner particles are negatively charged. The negatively charged toner particles receive an electrostatic repulsive force from the second cleaning brush 62. Therefore, the toner particles remain on the second-transfer belt 36 without being attracted to the second cleaning brush 62.

If any particles of the silver toner remain on the second-transfer belt 36, the particles of the silver toner pass through the second-transfer position NT with the rotation of the second-transfer belt 36. As a result, the particles of the silver toner may be transferred to the back side (a side facing the second-transfer belt 36) of the recording medium P passing through the second-transfer position NT.

Accordingly, in the embodiment, if the number of recording media P to which toner images (the silver image 310 and the other-color images 320) have been transferred (the number of recording media P that have undergone image formation) has reached a predetermined value or greater, the controller 70 executes a restricted mode (an exemplary transfer mode) in which the positions of the transfer belt 31 to which the silver patches 410 are transferred are restricted as described below. The predetermined value is, for example, two hundred thousand.

In the restricted mode, the silver patches 410 are transferred from the photoconductor drum 21V of the toner-image-forming unit 20V to respective positions of the transfer belt 31 that do not overlap a subsequent recording medium P in the direction of introduction (the direction of transport) of the recording medium P into the second-transfer position NT. The term "subsequent recording medium P" refers to a recording medium P to be introduced into the second-transfer position NT (an exemplary transfer nip) after the silver patches 410.

In the embodiment, for example, the recording medium P to be introduced into the second-transfer position NT after the silver patches 410 transferred to a non-transfer area R2(A) illustrated in FIG. 4 is a recording medium P(1) to which the other-color images 320 and the silver image 310 transferred to a transfer area R1(A) illustrated in FIG. 4 are to be transferred. The transfer area R1(A) is adjacent to and on the downstream side with respect to the non-transfer area R2(A) in the direction of transport.

Furthermore, in the embodiment, for example, the recording medium P to be introduced into the second-transfer position NT after the silver patches 410 transferred to a non-transfer area R2(B) illustrated in FIG. 4 is a recording medium P(2) to which the other-color images 320 and the silver image 310 transferred to a transfer area R1(B) illustrated in FIG. 4 are to be transferred. The transfer area R1(B) is adjacent to and on the downstream side with respect to the non-transfer area R2(B) in the direction of transport.

In FIG. 4, one-dot chain lines represent two width-direction ends of the recording medium P to which the other-color images 320 and the silver image 310 in each of the transfer areas R1 are to be transferred, i.e., the two ends of the recording medium P in the direction orthogonal to the direction of introduction of the recording medium P into the second-transfer position NT. In FIG. 4, the direction of introduction of the recording medium P into the second-transfer position NT (the direction of transport) is represented by an arrow C.

Arbitrary positions in areas on the two respective width-direction outer sides (the upper side and the lower side in FIG. 4) of the recording medium P correspond to the positions that do not overlap the subsequent recording medium P in the direction of introduction of the recording medium P. In the embodiment, the silver patches 410 are transferred from the photoconductor drum 21V of the toner-image-forming unit 20V to respective arbitrary positions of the non-transfer area R2 that are on the two width-direction outer sides of the subsequent recording medium P. In the exemplary case illustrated in FIG. 4, when seen in the direction of introduction of the recording medium P, the silver patches 410 are transferred to respective positions that do not overlap recording media P to be introduced into the second-transfer position NT after the subsequent recording medium P. Accordingly, the silver toner forming the silver patches 410 on the transfer belt 31 is transferred to positions of the second-transfer belt 36 that do not overlap the subsequent recording medium P in the direction of introduction of the recording medium P.

In the embodiment, the controller 70 acquires information on the length (width) of the subsequent recording medium P in the direction orthogonal to the direction of introduction. On the basis of the information, the controller 70 recognizes the areas that are on the two width-direction outer sides of the recording medium P. The controller 70 acquires the information on the width of the subsequent recording medium P on the basis of information on the size of the recording medium P that is inputted thereto through an operation unit (a user interface) such as an operation panel.

Alternatively, the width of the recording medium P may be detected by a detecting unit (a sensor). In that case, the detecting unit (sensor) is provided in the container 51 or on the transport path extending from the container 51 to the second-transfer position NT.

If recording media P of the same size are used for each single job, the areas on the two width-direction outer sides of the recording medium P are uniform for all of the recording media P. Therefore, the positions of the transfer belt 31 to which the silver patches 410 are to be transferred may be determined for each job. The term "job" refers to the unit of processing in an image forming operation to be executed by the controller 70 at the receipt of an image forming command.

With the rotation of the second-transfer belt 36, a portion of the second-transfer belt 36 to which the silver toner is transferred from the transfer belt 31 reaches the second-transfer position NT synchronously with the passing of the subsequent recording medium P through the second-transfer position NT.

In the restricted mode, the other-color patches 420 are transferred to respective arbitrary positions in the non-transfer area R2. That is, the other-color patches 420 may be transferred to the non-transfer area R2 either at positions that do not overlap the subsequent recording medium P or at positions that overlap the subsequent recording medium P in the direction of introduction of the recording medium P (see the non-transfer areas R2(A) and R2(B) illustrated in FIG. 4).

In the restricted mode, a second voltage (a voltage within the range V2 in the graph illustrated in FIG. 6) that is suitable for the removal of the other-color toners is applied to the first cleaning brush 61 and the second cleaning brush 62 from the first power-feeding unit 65 and the second power-feeding unit 66, respectively, regardless of whether toner particles transferred to the second-transfer belt 36 are of the silver toner or of the other-color toners.

If the number of recording media P to which toner images have been transferred (the number of recording media P that have undergone image formation) has not reached the predetermined value, the controller 70 controls the first power-feeding unit 65 and the second power-feeding unit 66 such that the first power-feeding unit 65 and the second power-feeding unit 66 apply a first voltage (a voltage within the range V1 in the graph illustrated in FIG. 6) to the first cleaning brush 61 and the second cleaning brush 62, respectively, regardless of whether toner particles transferred to the second-transfer belt 36 are of the silver toner or of the other-color toners.

Featured Operations According to the Embodiment

Featured operations according to the embodiment will now be described.

In the case where the number of recording media P to which toner images have been transferred has reached the predetermined value or greater, when the controller 70 receives an image forming command (a printing command), the controller 70 executes an image forming operation on a recording medium P in the restricted mode.

Specifically, the controller 70 activates the toner-image-forming unit 20V for the silver color, the toner-image-forming units 20Y, 20M, 20C, and 20K for the other colors, the transfer device 30, and the fixing device 40 (see FIG. 1) as follows.

The toner-image-forming unit 20V forms a silver image 310 (see FIG. 4) and silver patches 410 (see FIG. 4), and the toner-image-forming units 20Y, 20M, 20C, and 20K form other-color images 320 (see FIG. 4) and other-color patches 420 (see FIG. 4) in accordance with the following image forming process. The photoconductor drums 21 for the respective colors are charged by the respective chargers 22 while being rotated. The charged photoconductor drums 21 are exposed to light emitted from the respective exposure devices 23, whereby electrostatic latent images are formed on the surfaces of the respective photoconductor drums 21. The electrostatic latent images on the photoconductor drums 21 are developed with the developers (toners) supplied from the respective developing devices 24, whereby other-color images 320 and other-color patches 420 in the colors of yellow (Y), magenta (M), cyan (C) and black (K) are formed on the photoconductor drums 21Y, 21M, 21C, and 21K for the other colors, and a silver image 310 and silver patches 410 are formed on the photoconductor drum 21V for the silver color.

As illustrated in FIG. 4, the other-color images 320 and the silver image 310 formed on the photoconductor drums 21 are sequentially transferred by the respective first-transfer rollers 33 to a transfer area R1 of the transfer belt 31 that is under rotation.

The other-color patches 420 formed on the respective photoconductor drums 21 are sequentially transferred by the respective first-transfer rollers 33 to respective arbitrary positions in a non-transfer area R2 of the transfer belt 31 that is under rotation.

The silver patches 410 formed on the photoconductor drum 21V are transferred by the first-transfer roller 33V to respective positions in the non-transfer area R2 of the rotating transfer belt 31 that do not overlap the subsequent recording medium P in the direction of introduction of the recording medium P. Specifically, the silver patches 410 are transferred to respective positions of the transfer belt 31 that are on the two width-direction outer sides of the subsequent recording medium P.

The other-color patches 420, the silver patches 410, the other-color images 320, and the silver image 310 thus transferred to the transfer belt 31 are transported to the second-transfer position NT with the rotation of the transfer belt 31.

A recording medium P is fed to the second-transfer position NT by the transport rollers 52 synchronously with the transport of the other-color images 320 and the silver image 310. When the recording medium P, the other-color images 320, and the silver image 310 (the transfer area R1) pass through the second-transfer position NT, the second-transfer voltage (a positive voltage) is applied to the second-transfer roller 34 via the counter roller 32B. Thus, the other-color images 320 and the silver image 310 are transferred from the transfer belt 31 to the recording medium P.

The recording medium P now having the other-color images 320 and the silver image 310 is transported from the second-transfer position NT to the fixing device 40 by the transport belts 58. In the fixing device 40, the other-color images 320 and the silver image 310 on the recording medium P are fixed to the recording medium P.

When no recording medium P but the silver patches 410 and the other-color patches 420 pass through the second-transfer position NT, the non-transfer voltage (a negative voltage) is applied to the second-transfer roller 34 via the counter roller 32B. Hence, the silver patches 410 and the other-color patches 420 on the transfer belt 31 receive a repulsive force from the second-transfer roller 34 (the second-transfer belt 36) and are retained on the transfer belt 31. Thus, the silver toner forming the silver patches 410 and the other-color toners forming the other-color patches 420 pass through the second-transfer position NT while being retained on the transfer belt 31, and are transported to the cleaning device 35, where the silver toner and the other-color toners are removed from the transfer belt 31.

As described above, the non-transfer voltage is applied to the second-transfer roller 34. However, since the second-transfer belt 36 and the transfer belt 31 are in contact with each other under a predetermined load, some particles of the silver toner forming the silver patches 410 and some particles of the other-color toners forming the other-color patches 420 are transferred to the second-transfer belt 36 even under an electrostatic repulsive force. Furthermore, if the silver toner forming the silver patches 410 and the other-color toners forming the other-color patches 420 pass through the second-transfer position NT with some particles thereof being positively charged with the injection of positive charge, such particles receive an electrostatic attractive force and are transferred to the second-transfer belt 36.

In the embodiment, the silver toner forming the silver patches 410 is transferred to positions of the second-transfer belt 36 that do not overlap the subsequent recording medium P in the direction of introduction of the recording medium P. The silver toner and the other-color toners transferred to the second-transfer belt 36 as described above are transported to the first cleaning brush 61 and the second cleaning brush 62 with the rotation of the second-transfer belt 36.

In the embodiment, the first power-feeding unit 65 applies a positive second voltage (a voltage within the range V2 in FIG. 6) to the first cleaning brush 61. Hence, some negatively charged particles of the other-color toners and the silver toner on the second-transfer belt 36 are electrostatically attracted to the first cleaning brush 61 and are removed from the second-transfer belt 36.

Meanwhile, the second power-feeding unit 66 applies a negative second voltage (a voltage within the range V2 in FIG. 6) to the second cleaning brush 62. Hence, some positively charged particles of the other-color toners and the silver toner on the second-transfer belt 36 are electrostatically attracted to the second cleaning brush 62 and are removed from the second-transfer belt 36.

As described above, in the embodiment, since the second voltage that is suitable for the removal of the other-color toners is used, the amount of particles of the silver toner that remain on the second-transfer belt 36 may exceed the allowable range. Nevertheless, in the embodiment, such particles of the silver toner are present at positions that do not overlap the subsequent recording medium P in the direction of introduction of the recording medium P. Therefore, the particles of the silver toner are less likely to be transferred to the back side (the side facing the second-transfer belt 36) of the subsequent recording medium P than in a case where particles of the silver toner are transferred to any positions of the transfer belt 31 that overlap the subsequent recording medium P in the direction of introduction of the recording medium P.

The particles of the silver toner that have remained on the second-transfer belt 36 are transported to the second-transfer position NT with the rotation of the second-transfer belt 36, and some of the particles of the silver toner come into contact with the transfer belt 31, thereby being retransferred to the transfer belt 31 and being removed from the second-transfer belt 36 by the cleaning device 35. The other particles of the silver toner that have not been retransferred to the transfer belt 31 are transported to the first cleaning brush 61 and the second cleaning brush 62 with the rotation of the second-transfer belt 36. Then, the first cleaning brush 61 and the second cleaning brush 62 remove the particles of the silver toner. In this manner, the amount of unremoved particles of the silver toner remaining on the second-transfer belt 36 is reduced to a level within the allowable range.

First Modification

In the above embodiment, the restricted mode is executed regardless of the lightness of the subsequent recording medium P. The present invention is not limited to such a case. For example, the restricted mode may be executed if the side of the subsequent recording medium P that faces the second-transfer belt 36 has a lower lightness than the silver toner.

In a first modification, if the lightness of the recording medium P is higher than or equal to the lightness (for example, L*=60) of the silver toner (for example, if the recording medium P has a white color), the silver toner is less visible on the recording medium P. In contrast, if the recording medium P has a lower lightness than the silver toner (for example, if the recording medium P has a black color), the silver toner is more visible on the recording medium P. The first modification focuses on this characteristic of the silver toner and employs a configuration in which the positions of the transfer belt 31 to which the silver patches 410 are transferred are changed according to need.

Specifically, if the side of the subsequent recording medium P that faces the second-transfer belt 36 has a lower lightness than the silver toner, the silver patches 410 are transferred from the photoconductor drum 21V of the toner-image-forming unit 20V to respective positions in the non-transfer area R2 that do not overlap the subsequent recording medium P in the direction of introduction of the recording medium P.

Accordingly, particles of the silver toner forming the silver patches 410 are transferred to positions of the second-transfer belt 36 that do not overlap the subsequent recording medium P in the direction of introduction of the recording medium P. In the restricted mode, the electrostatic removal of the silver toner is performed by the first cleaning brush 61 and the second cleaning brush 62. However, since the removal is performed with the second voltage that is suitable for the removal of the other-color toners, the amount of particles of the silver toner that remain on the second-transfer belt 36 may exceed the allowable level. Nevertheless, the particles of the silver toner are present at positions that do not overlap the subsequent recording medium P in the direction of introduction of the recording medium P. Therefore, the particles of the silver toner are less likely to be transferred to the back side (the side facing the second-transfer belt 36) of the recording medium P that has a lightness that makes particles of the silver toner, if any are transferred thereto, more visible (noticeable).

The lightness of the silver toner is known in advance by, for example, forming a monochrome patch image having an area coverage (image coverage) of 100% on a recording medium P and measuring the monochrome patch image with a colorimeter (for example, X-Rite (a registered trademark) 938 manufactured by X-Rite Inc.). The lightness of the side of the recording medium P that faces the second-transfer belt 36 is known in the controller 70 on the basis of the color of the recording medium P (paper) that is inputted thereto through the operation unit (a user interface) such as an operation panel.

The lightness of the side of the recording medium P that faces the second-transfer belt 36 may be detected by a detecting unit (a sensor) when the recording medium P is introduced into the second-transfer position NT. Such a detecting unit (sensor) may be provided at, for example, a position on the transport path extending from the container 51 to the second-transfer position NT. In that case, for example, the lightness of the silver toner that has been measured in advance (a reference lightness) and the lightness of the recording medium P that is detected by the detecting unit are compared, and the restricted mode is executed if the detected lightness of the recording medium P is lower than the reference lightness.

If the side of the subsequent recording medium P that faces the second-transfer belt 36 has a lightness higher than or equal to the lightness of the silver toner, the silver patches 410 are transferred to arbitrary positions in the non-transfer area R2. That is, the silver patches 410 may be transferred to the non-transfer area R2 either at positions that do not overlap the subsequent recording medium P or at positions that overlap the subsequent recording medium P in the direction of introduction of the recording medium P.

In the first modification, an unallowable amount of particles of the silver toner remaining on the second-transfer belt 36 are allowed to be transferred to the back side (the side facing the second-transfer belt 36) of the recording medium P. Even if any particles of the silver toner remaining on the second-transfer belt 36 are transferred to the back side (the side facing the second-transfer belt 36) of the recording medium P, such particles of the silver toner are less visible and are less likely to be recognized as stains on the back side of the recording medium P.

In the first modification, as described above, if the side of the subsequent recording medium P that faces the second-transfer belt 36 has a lightness that is higher than or equal to the lightness of the silver toner, the silver patches 410 are transferred to arbitrary positions in the non-transfer area R2. Therefore, regardless of the lightness of the recording medium P, the degree of freedom in determining the sizes and the positions of the silver patches 410 to be transferred to the transfer belt 31 is higher than in the case where the silver patches 410 are transferred to positions of the transfer belt 31 that do not overlap the subsequent recording medium P in the direction of introduction of the recording medium P.

Second Modification

In the above embodiment, the other-color patches 420 are formed at arbitrary positions in the non-transfer area R2 in the restricted mode. The present invention is not limited to such a case. For example, in the restricted mode, the other-color patches 420 may be transferred to positions of the transfer belt 31 that overlap the subsequent recording medium P in the direction of introduction of the recording medium P so that the other-color toners are supplied to the position between the photoconductor drum 21V and the blade 25V of the toner-image-forming unit 20V.

Figure 8:
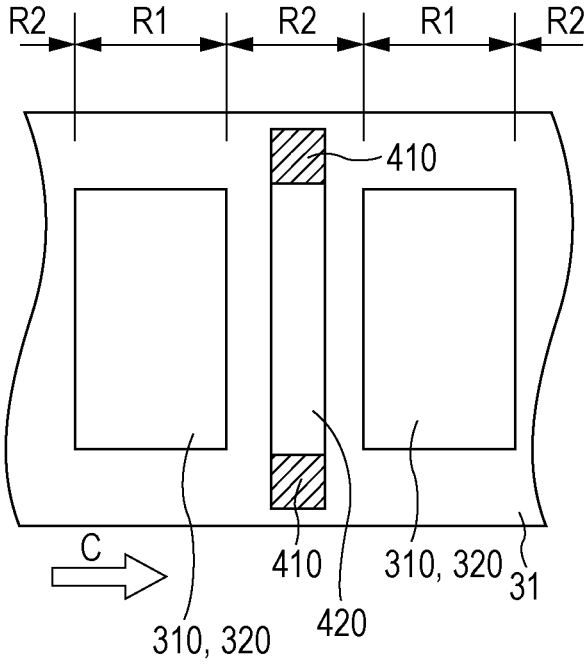
FIG. 8 illustrates an exemplary arrangement of the not-to-be-transferred images and the to-be-transferred images on the transfer belt in a second modification.

For example, in a second modification illustrated in FIG. 8, the other-color patches 420 are transferred from the respective photoconductor drums 21Y, 21M, 21C, and 21K to the non-transfer area R2 in a portion that overlaps the subsequent recording medium P and extends from one width-direction end to the other of the recording medium P when seen in the direction of introduction of the recording medium P.

First, a set of the other-color patches 420 is transferred to the transfer belt 31, and the silver patches 410 are then transferred to the transfer belt 31 at positions on the two respective width-direction outer sides of the recording medium P. In this state, the set of the other-color patches 420 is positioned between the silver patches 410 in such a manner as to connect the silver patches 410 to each other. In this state, the other-color patches 420 overlap the silver patches 410 in the direction orthogonal to the direction of introduction (represented by arrow C in FIG. 8) of the recording medium P into the second-transfer position NT. Hence, the silver patches 410 and the other-color patches 420 in combination form an image (a band) in an area of the transfer belt 31 that extends over a length from one end to the other of the blade 25V in the width direction, i.e., in the axial direction of the photoconductor drum 21V. The positions of the other-color patches 420 may be offset from the positions of the silver patches 410 in the direction of introduction of the recording medium P into the second-transfer position NT.

Figure 9:
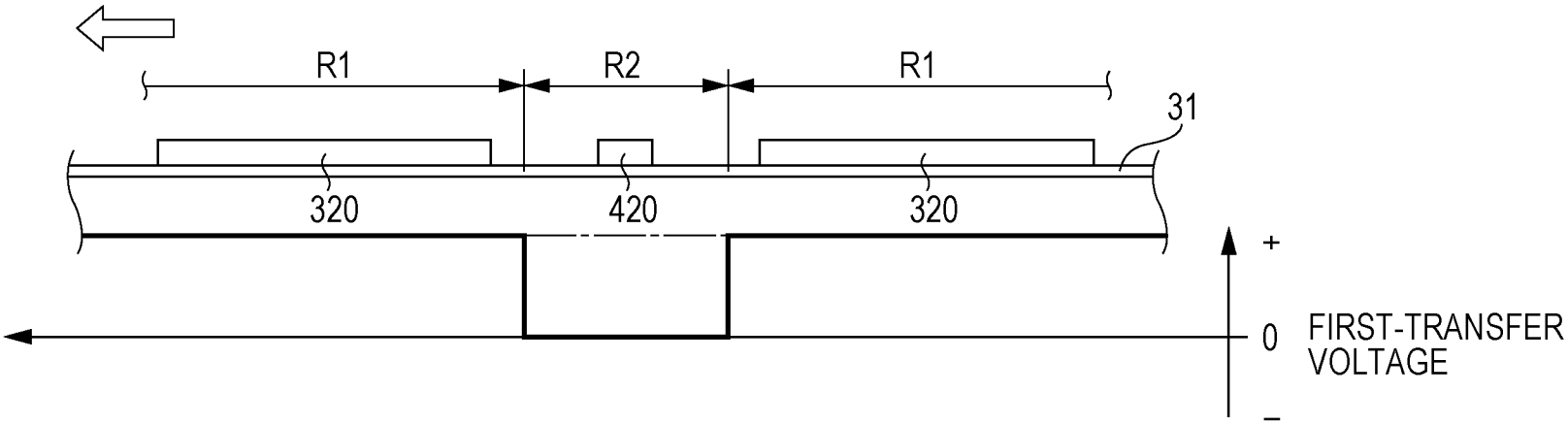
FIG. 9 illustrates how a first-transfer voltage is applied to a first-transfer roller in the second modification.

In the second modification, as illustrated in FIG. 9, the first-transfer voltage is applied to the first-transfer roller 33V when each transfer area R1 of the transfer belt 31 passes through the first-transfer position TV, and the application of the first-transfer voltage to the first-transfer roller 33V is stopped when each non-transfer area R2 of the transfer belt 31 passes through the first-transfer position TV.

That is, the first-transfer voltage is not applied to the first-transfer roller 33V when the other-color patches 420 transferred to positions of the transfer belt 31 that overlap the subsequent recording medium P in the direction of introduction of the recording medium P are introduced into the first-transfer position TV.

By stopping the application of the first-transfer voltage to the first-transfer roller 33V as described above, the other-color toners forming the other-color patches 420 transferred to the non-transfer area R2 are more likely to be transferred to the photoconductor drum 21V than in the case where the first-transfer voltage is applied to the first-transfer roller 33V. Furthermore, the amount of particles of the silver toner forming the silver patches 410 that are transferred from the photoconductor drum 21V to the transfer belt 31 is smaller than in the case where the first-transfer voltage is applied to the first-transfer roller 33V. Hence, particles of the silver toner are more likely to be retained on the photoconductor drum 21V.

Particles of the other-color toners transferred to the photoconductor drum 21V and particles of the silver toner retained on the photoconductor drum 21V are supplied to the position between the photoconductor drum 21V and the blade 25V.

Since not only particles of the silver toner but also particles of the other-color toners are supplied to the position between the photoconductor drum 21V and the blade 25V, the wear and the burr of the blade 25V are less likely to occur than in the case where only particles of the silver toner are supplied to the position between the photoconductor drum 21V and the blade 25V.

In the second modification, as described above, the first-transfer voltage is not applied to the first-transfer roller 33V when the other-color patches 420 are introduced into the first-transfer position TV. Therefore, the amount of particles of the other-color toners transferred to the photoconductor drum 21V is larger than in the case where the first-transfer voltage is applied to the first-transfer roller 33V when the other-color patches 420 are introduced into the first-transfer position TV. Accordingly, the amount of particles of the other-color toners supplied to the position between the photoconductor drum 21V and the blade 25V increases, and the occurrence of the wear and the burr of the blade 25V is effectively suppressed.

Some particles of the other-color toners that have not been transferred from the transfer belt 31 to the photoconductor drum 21V and some particles of the silver toner that have been transferred from the photoconductor drum 21V to the transfer belt 31 are transferred to the second-transfer belt 36. Then, the particles of the silver toner transferred to the second-transfer belt 36 are subjected to the electrostatic removal performed by the first cleaning brush 61 and the second cleaning brush 62. However, since the second voltage that is suitable for the removal of the other-color toners is applied to the first cleaning brush 61 and the second cleaning brush 62, an unallowable amount of particles of the silver toner may remain on the second-transfer belt 36. Nevertheless, since such particles of the silver toner are present at positions that do not overlap the subsequent recording medium P in the direction of introduction of the recording medium P, the particles of the silver toner are less likely to be transferred to the back side (the side facing the second-transfer belt 36) of the subsequent recording medium P.

Figure 10:
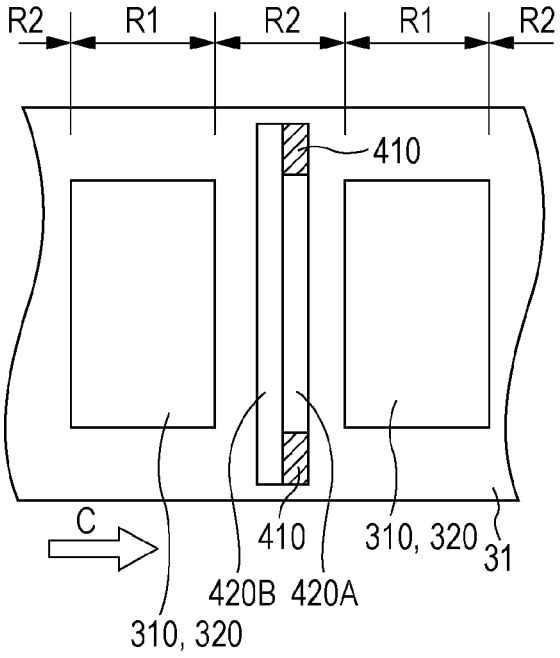
FIG. 10 illustrates another exemplary arrangement of the not-to-be-transferred images and the to-be-transferred images on the transfer belt in the second modification.

In the second modification, as illustrated in FIG. 10, an other-color patch 420A provided between the silver patches 410 and an other-color patch 420B may be transferred to the transfer belt 31. The other-color patch 420B is provided in such a manner as to overlap the silver patches 410 and the other-color patch 420A in the direction of introduction of the recording medium P into the second-transfer position NT. Accordingly, the amount of particles of the other-color toners supplied to the position between the photoconductor drum 21V and the blade 25V becomes larger and the occurrence of the wear and the burr of the blade 25V is more effectively suppressed than in the case where only the other-color patch 420A is transferred to the transfer belt 31.

The second modification employs a supply mode in which the other-color toners forming the other-color patches 420 formed by the photoconductor drums 21Y, 21M, 21C, and 21K are each supplied to a position between a corresponding one of the photoconductor drums 21Y, 21M, 21C, and 21K and a corresponding one of the blades 25Y, 25M, 25C, and 25K. In the supply mode, a supply-purpose image (a band) is formed on each of the photoconductor drums 21Y, 21M, 21C, and 21K in such a manner as to extend from one axial end to the other of the photoconductor drum 21Y, 21M, 21C, or 21K. With the rotation of the photoconductor drums 21Y, 21M, 21C, and 21K, the other-color toners forming the supply-purpose images are each supplied to the position between the photoconductor drum 21Y, 21M, 21C, or 21K and the blade 25Y, 25M, 25C, or 25K. When the supply-purpose images pass through the first-transfer positions T, the first-transfer voltage is not applied to the first-transfer rollers 33Y, 33M, 33C, and 33K.

In the second modification, the other-color patches 420 formed in the restricted mode may have a higher density than the other-color patches 420 formed in the supply mode. That is, in the second modification, the density of the other-color patches 420 formed on the photoconductor drums 21Y, 21M, 21C, and 21K is higher in the case where the other-color toners are supplied to the position between the photoconductor drum 21V and the blade 25V than in the case where the other-color toners are supplied to the respective positions between the photoconductor drums 21Y, 21M, 21C, and 21K and the blades 25Y, 25M, 25C, and 25K.

Accordingly, the amount of particles of the other-color toners supplied to the position between the photoconductor drum 21V and the blade 25V becomes larger and the occurrence of the wear and the burr of the blade 25V is more effectively suppressed than in the case where the density of the other-color patches 420 in the restricted mode is the same as that in the supply mode.

Other Modifications

In the above embodiment, the silver toner is employed as the toner containing the metal pigment. The present invention is not limited to such a case. For example, a gold toner may be employed as the toner containing the metal pigment. The gold toner contains, for example, a metal pigment, a yellow pigment, and a binder resin.

In the above embodiment, the second voltage (a voltage within the range V2 in FIG. 6) is applied to each of the first cleaning brush 61 and the second cleaning brush 62 if the number of recording media P to which toner images have been transferred (the number of recording media P that have undergone image formation) has reached a predetermined value or greater. The present invention is not limited to such a case. In a case where the number of recording media P to which toner images have been transferred has not reached the predetermined value and the voltage suitable for the removal of the silver toner (a voltage within the range V1 in FIG. 6) and the voltage suitable for the removal of the other-color toners (a voltage within the range V2 in FIG. 6) are different from each other, the second voltage (a voltage within the range V2 in FIG. 6) may be applied to the first cleaning brush 61 and the second cleaning brush 62 regardless of the number of recording media P to which toner images have been transferred. In the case where the number of recording media P to which toner images have been transferred is below the predetermined value, the voltage suitable for the removal of the silver toner and the voltage suitable for the removal of the other-color toners become different from each other when, for example, the first cleaning brush 61 and the second cleaning brush 62 (or the second-transfer roller 34) are each made of a material having a high resistance or when the allowable amount of unremoved toner particles is small.

In the above embodiment, in the restricted mode, the silver patches 410 are transferred to positions in the non-transfer area R2 that do not overlap the subsequent recording medium P in the direction of introduction of the recording medium P. Alternatively, the silver patches 410 may be transferred to positions in the transfer area R1 that do not overlap the subsequent recording medium P in the direction of introduction of the recording medium P.

Figure 11:
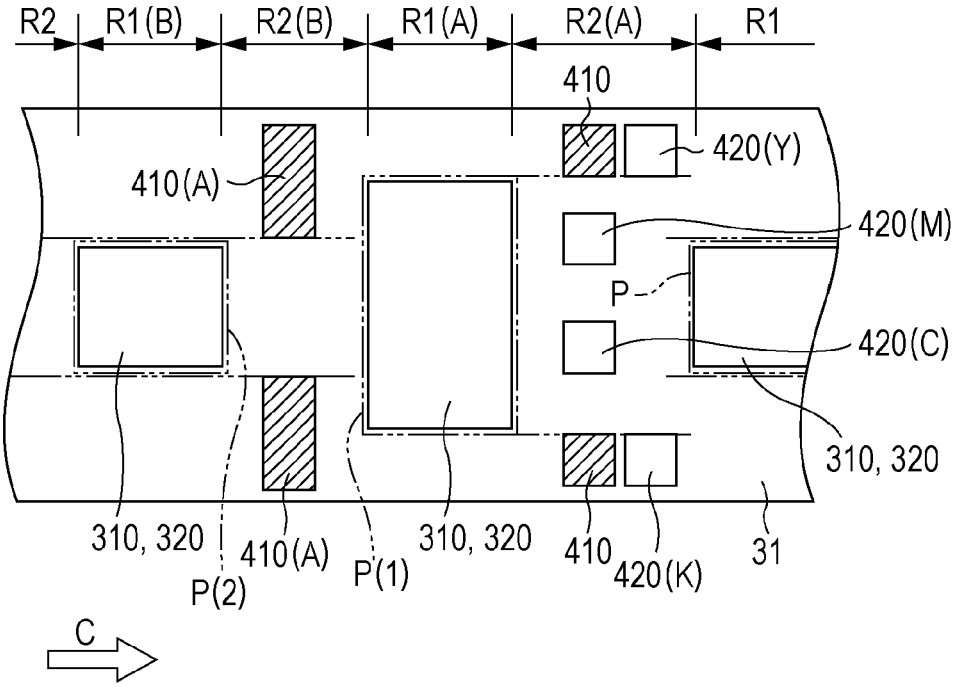
FIG. 11 illustrates an exemplary arrangement of the not-to-be-transferred images and the to-be-transferred images on the transfer belt in another modification.

In the above embodiment, the silver patches 410 transferred to the transfer belt 31 do not overlap, in the direction of introduction, recording media P to be introduced into the second-transfer position NT after the subsequent recording medium P. The present invention is not limited to such a case. That is, the silver patches 410 only need to be transferred to positions that do not overlap the subsequent recording medium P in the direction of introduction of the recording medium P, and may overlap, in the direction of introduction, recording media P to be introduced into the second-transfer position NT after the subsequent recording medium P. Hence, for example, in a case where recording media P of different sizes are used in one job as illustrated in FIG. 11, silver patches 410(A) may be transferred to positions that overlap, in the direction of introduction, a recording medium P(1) to be introduced into the second-transfer position NT after a subsequent recording medium P. In such a configuration, the degree of freedom in determining the sizes and the positions of the silver patches 410 to be transferred to the transfer belt 31 is increased.

As the second-transfer belt 36 rotates, unremoved particles of the silver toner remaining on the second-transfer belt 36 are transported to the second-transfer position NT and some particles of the silver toner come into contact with the transfer belt 31. In such a case, the particles of the silver toner are retransferred to the transfer belt 31 and are removed by the cleaning device 35. The other particles of the silver toner that have not been retransferred to the transfer belt 31 are transported to the first cleaning brush 61 and the second cleaning brush 62 with the rotation of the second-transfer belt 36. These particles of the silver toner are then subjected to the cleaning operation performed by the first cleaning brush 61 and the second cleaning brush 62. Thus, the amount of unremoved particles of the silver toner remaining on the second-transfer belt 36 is reduced to a level within the allowable range. Hence, particles of the silver toner are less likely to be transferred to a recording medium P(2) to be introduced into the second-transfer position NT after a subsequent recording medium P(1).

In the above embodiment, a cleaning brush is employed as the removing member that removes toner particles by utilizing an electrostatic force. The present invention is not limited to such a case. The removing member may alternatively be a cleaning roller.

In the above embodiment, both the first cleaning brush 61 and the second cleaning brush 62 are provided. Alternatively, only one of the first cleaning brush 61 and the second cleaning brush 62 may be provided.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first forming unit that forms a first to-be-transferred image and a first not-to-be-transferred image with a first toner containing a metal pigment;

a second forming unit that forms a second to-be-transferred image and a second not-to-be-transferred image with a second toner that is free of any metal pigment;

a transfer body to which the first to-be-transferred image, the first not-to-be-transferred image, the second to-be-transferred image, and the second not-to-be-transferred image are to be transferred;

a transfer member that transfers the first to-be-transferred image and the second to-be-transferred image to a recording medium at a transfer nip between the transfer member and the transfer body; and a removing member that removes particles of the first toner forming the first not-to-be-transferred image and particles of the second toner forming the second not-to-be-transferred image that have adhered to the transfer member from the transfer member with an electrostatic force, wherein the image forming apparatus has a transfer mode in which the first not-to-be-transferred image is transferred to a position of the transfer body that is on an outer side of the recording medium to be introduced into the transfer nip after the first not-to-be-transferred image, the position being on the outer side of the recording medium when seen in a direction of introduction of the recording medium into the transfer nip, wherein the position is where the first not-to-be-transferred image contacts the transfer member.

2. The image forming apparatus according to claim 1, wherein the image forming apparatus executes the transfer mode if a side of the recording medium to be introduced into the transfer nip after the first not-to-be-transferred image has a lightness that is lower than a lightness of the first toner, the side of the recording medium facing the transfer member.

3. The image forming apparatus according to claim 1, wherein the first forming unit includes a forming body on which the first to-be-transferred image and the first not-to-be-transferred image are to be formed; and a removing body that is in contact with the forming body and removes particles of the first toner that remain on the forming body after the transfer of the first to-be-transferred image and the first not-to-be-transferred image from the forming body to the transfer body, wherein the first forming unit is provided on a downstream side with respect to the second forming unit, and wherein, in the transfer mode, the second toner is supplied into a position between the forming body and the removing body by transferring the second not-to-be-transferred image from the second forming unit to a position of the transfer body that overlaps the recording medium to be introduced into the transfer nip after the first not-to-be-transferred image, the position overlapping the recording medium in the direction of introduction of the recording medium.

4. The image forming apparatus according to claim 3, wherein the second forming unit includes a forming body on which the second to-be-transferred image and the second not-to-be-transferred image are to be formed; and a removing body that is in contact with the forming body and removes particles of the second toner that remain on the forming body after the transfer of the second to-be-transferred image from the forming body to the transfer body, wherein the image forming apparatus has a supply mode in which the second toner forming the second not-to-be-transferred image on the forming body of the second forming unit is supplied to a position between the forming body of the second forming unit and the removing body of the second forming unit, and wherein the second not-to-be-transferred image formed in the transfer mode has a higher density than the second not-to-be-transferred image formed in the supply mode, and wherein, in the transfer mode, the second toner forming the second not-to-be-transferred image is supplied to the position between the forming body of the first forming unit and the removing body of the first forming unit by transferring the second not-to-be-transferred image having the higher density from the forming body to the position of the transfer body that overlaps the recording medium.

5. The image forming apparatus according to claim 3, further comprising:

a transfer unit that transfers the first to-be-transferred image formed on the forming body of the first forming unit to the transfer body when a transfer voltage is applied to the transfer unit, wherein, in the transfer mode, the application of the transfer voltage to the transfer unit is stopped when the second not-to-be-transferred image transferred to the position of the transfer body that overlaps the recording medium is introduced into the position between the forming body of the first forming unit and the transfer unit.

6. The image forming apparatus according to claim 1, further comprising cleaning brushes having a voltage applied thereto with an opposite polarity to a charge of particles of the not-to-be-transferred images to thereby remove the particles of the not-to-be-transferred images on the outer side.

7. An image forming method comprising:

forming a first to-be-transferred image and a first not-to-be-transferred image with a first toner containing a metal pigment;

forming a second to-be-transferred image and a second not-to-be-transferred image with a second toner that is free of any metal pigment;

transferring the first to-be-transferred image, the first not-to-be-transferred image, the second to-be-transferred image, and the second not-to-be-transferred image to a transfer body;

transferring the first to-be-transferred image and the second to-be-transferred image to a recording medium at a transfer nip between a transfer member and the transfer body; and removing particles of the first toner forming the first not-to-be-transferred image and particles of the second toner forming the second not-to-be-transferred image that have adhered to the transfer member from the transfer member with an electrostatic force, wherein, in a transfer mode, the first not-to-be-transferred image is transferred to a position of the transfer body that is on an outer side of the recording medium to be introduced into the transfer nip after the first not-to-be-transferred image, the position being on the outer side of the recording medium when seen in a direction of introduction of the recording medium into the transfer nip, wherein the position is where the first not-to-be-transferred image contacts the transfer member.

* * * * *